US008286988B2

(12) United States Patent
Jones

(10) Patent No.: US 8,286,988 B2
(45) Date of Patent: Oct. 16, 2012

(54) SKI ATTACHMENTS HAVING A BOAT SHAPE/NAVICULAR DESIGN FOR BOTTOM OF TOE AND A TOP SUPPORT FOR FRONT OF MANUFACTURED SKIS

(76) Inventor: Lynn Robert Jones, Fontana, CA (US)

( * ) Notice: Subject to any disclaimer, the term of this patent is extended or adjusted under 35 U.S.C. 154(b) by 0 days.

(21) Appl. No.: 12/460,471

(22) Filed: Jul. 20, 2009

(65) Prior Publication Data

US 2011/0012335 A1 Jan. 20, 2011

(51) Int. Cl.

| | |
|---|---|
| ***A63C 5/00*** | (2006.01) |
| ***A63C 5/07*** | (2006.01) |
| ***B63B 1/00*** | (2006.01) |
| ***B63B 35/81*** | (2006.01) |

(52) U.S. Cl. ..... 280/601; 280/602; 441/68; 441/74

(58) Field of Classification Search ..... 280/11.12, 280/600, 601, 602, 608, 609, 610, 11.18, 280/14.21, 15, 16, 21.1, 28.14; 441/68, 74, 441/79; 180/180, 182, 183

See application file for complete search history.

(56) References Cited

U.S. PATENT DOCUMENTS

| | | | | |
|---|---|---|---|---|
| 1,225,444 | A * | 5/1917 | Leclair | 180/183 |
| 3,599,259 | A * | 8/1971 | Shewmon | 441/70 |
| 4,180,275 | A * | 12/1979 | Montoya | 280/601 |
| 4,189,163 | A | 2/1980 | Schweizer | |
| 4,219,206 | A | 8/1980 | Kjesbo | |
| 4,405,149 | A | 9/1983 | Piegay | |
| 4,438,946 | A | 3/1984 | Piegay | |
| 4,563,020 | A * | 1/1986 | Arieh et al. | 280/602 |
| 4,616,842 | A | 10/1986 | Echevin | |
| 4,858,945 | A | 8/1989 | Kashiwa | |
| 5,360,220 | A * | 11/1994 | Simmons | 280/28 |
| 5,360,228 | A | 11/1994 | Palau | |
| 5,397,153 | A | 3/1995 | Dutaut | |
| 5,435,589 | A | 7/1995 | Fagot | |
| 5,618,054 | A | 4/1997 | Fagot | |
| 5,934,961 | A * | 8/1999 | Mehrmann et al. | 441/65 |
| 6,247,985 | B1 * | 6/2001 | Block et al. | 441/79 |
| 6,331,008 | B2 * | 12/2001 | Cormican | 280/22 |
| 7,287,763 | B1 * | 10/2007 | Beaudoin | 280/28 |
| 2002/0041080 | A1 * | 4/2002 | Moriyama et al. | 280/609 |
| 2004/0176000 | A1 * | 9/2004 | Mann | 441/74 |

FOREIGN PATENT DOCUMENTS

FR 2554004 A1 * 5/1985

OTHER PUBLICATIONS

Internet—www.Firebirds.org/menu 13/mnul3 The Lockheed Hercules C-130 D.

Radio Control Airplane, "How To's" vol. 2, by Air Age Inc. copyright 1994.

* cited by examiner

*Primary Examiner* — John R Olszewski

(57) ABSTRACT

Snow ski attachments to toe of ski consisting of boat haul/navicular design bottom component J-tip 10 along with top support brace 30 and top cover 42. This will allow the ski to cut through the snow instead of bouncing over it and therefore reducing vibration and improving the control of the ski. These attachments will also strengthen the toe to body connection.

1 Claim, 4 Drawing Sheets

Figure 1:
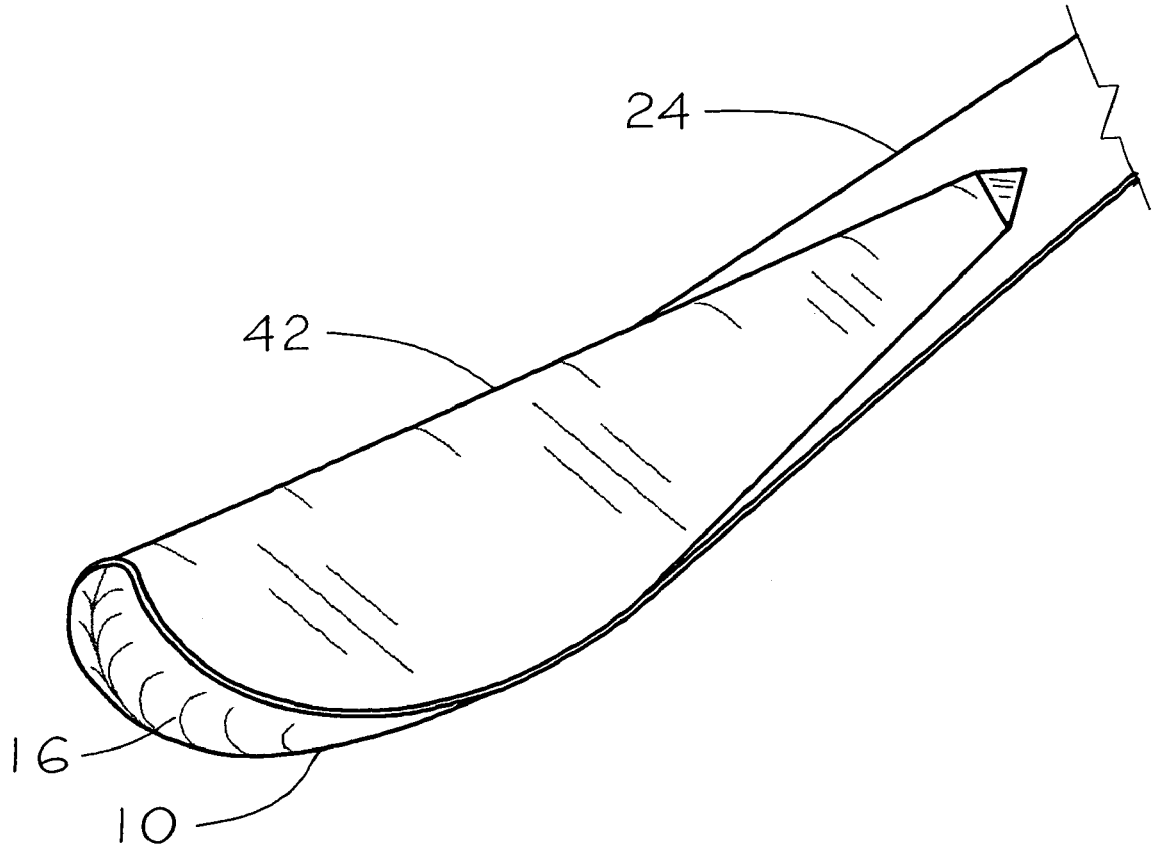

SKI ATTACHMENTS HAVING A BOAT SHAPE/NAVICULAR DESIGN FOR BOTTOM OF TOE AND A TOP SUPPORT FOR FRONT OF MANUFACTURED SKIS

CROSS-REFERENCE TO RELATED APPLICATIONS

Not applicable

FEDERALLY SPONSORED RESEARCH

Not applicable

SEQUENCE LISTING OF PROGRAM

Not applicable

BACKGROUND OF INVENTION

1. Field of Invention

This invention introduces a new shape attachments consisting of a boat shape/navicular design secured through the bottom of the toe and fixed to a top support located on top of an existing snow ski.

2. Background of the Invention

According to U.S. Pat. No. 4,616,84 to Michel Echevin (1986) states, skis in general comprise a ski body extending from the tip at the leading end to the rear end and along its length, the ski is divided into three zones, namely, a forward zone which is frequently referred to as a shovel or toe of the ski, terminating in a somewhat upwardly turned tip, a central zone extending over most of the length of the ski and upon which the bindings are mounted, and a rear zone running to the rear end of the ski and generally referred to as the tail.

The shovel zone of the ski generally has a surface which diminishes in area in the forward direction, i.e. converges toward the tip which can be more or less pointed, more or less upwardly directed or raised or more or less rounded depending upon the ski design.

Invariably, however, the tip or end of the shovel portion of the ski is located subsequently above the snow upon which the ski rides. The shovel, therefore, does not contribute significantly to the sliding support of the ski on the snow. It is however necessary to allow the ski to ride over irregularities in the snow surface and to prevent crossing of the skis in use.

Because this shovel portion of the ski is located largely above the ski surface and has a comparatively large rigid mass, this mass is suspended or supported in a cantilever fashion upon a portion of the ski in constant contact with the snow surface and contributes an inertial mass which plays a significant role in the amplitude of vibrations generated in the body of the ski and excited by the multiple shocks and impacts generated during use of the ski.

Furthermore, the shovel portion of the ski is a particularly sensitive part thereof because the ski body generally tapers in thickness towards this part so that fabrication of the ski is complicated in this region, and this region may represent the most fragile portion of the ski, especially in modern skis which are generally lanunated from numerous layers of different materials. Bonding of these layers together is often a problem, particularly in the curved region, of the shovel part of the ski.

U.S. Pat. No. 4,405,149 to Yves Piegay (1983) discusses the subject of vibrating phenomena and conventional skis. Because of the ski structure or because of the nature of the snow upon which the ski is to slide, are frequently induced to vibrate and thereby create problems. These problems include the generation of noise which is an inconvenience to the skier, the transmission of vibrations to the legs of the skier thereby leading to discomfort of the skier, and the creation of drawbacks in skiing performance. These drawbacks include the grip of the ski on ice or frozen snow, the stability of the ski as it passes over bumps and rises, and the stability of the ski during turns. Furthermore, the vibration severely limits the free sliding characteristics of the ski on the snow.

Contained in U.S. Pat. No. 4,858,945 to Bryan A. Kashiva (1989) is an excellent explanation on the various snow skis and the method of making the same.

It states, as we approach present day ski designs, it appears that the evolution of the design of skis have been such that many earlier designs have, in a structural sense, given way to only a few current designs. Further the design parameters have been channeled so that in terms of structural characteristics, the present day skis lie within a relatively narrow range of flexural stiffness, tortional stiffness, weight and strength. These have in a sense set the standards by which any new ski design must be measured.

Further, as indicated previously, the main design parameters became channeled into relatively narrow ranges which had been proven to be acceptable to the new user. It is believed that the overall trend of this evolution of ski designs has had the effect, as it often does with many technologies, of channeling of narrowing the design efforts along certain known avenues.

Bryan says to the best knowledge of the applicant, the design and fabrication method shown here has never been disclosed. The design and fabrication method is useful to both the consumer and the manufacturer. As such, the design and fabrication method shown here solves a longstanding problem that many skilled ski engineers have studied. That is the problem of finding a new ski design that has both skiing performance advantages and manufacturing cost advantages over ski designs currently in widespread use.

This invention originates in the aerospace industry. Its concept has even been proven by the toy industry. Contained in a publication of RADIO CONTROL AIRPLANE on How To's, Volume 2 Publish 1994 is an article on page 19 entitled Wings of Winter, FLYING WITH SKIS.

Under the section called FLYING WITH FLOATS it states, if you fly off water in the summer, just put your plane back on the floats, remove the water rudders and go for it! Floats tend to work much better than skis, especially on powdery snow. There's a real thrill in flaring at touchdown, hearing the hiss of the floats as they ease into the snow and throw a rooster-tail of powder onto the air.

On snow, flat-bottom floats seem to work better than vee-bottom floats. Flat-bottom floats tend to plane up out of the snow more quickly, and they hold up to the pounding of flying off snow, especially crusty snow and ice.

To further support the functionality of this invention, please refer to the enclosed photograph article that was found on the INTERNET. From the aerospace industry the Lockheed HERCULES C-130D is configured for snow, which is represented by the letter D.

Please, pay attention to the pictures of the individual skis. According to the article, this design configuration has been utilized by the department of defense since the early 1960s.

This invention is utilizing proven aerospace technology that will be adapted to the sports entertainment technology of the snow ski industry.

BACKGROUND OF INVENTION—OBJECTS AND ADVANTAGES

It is the principle object of the present invention is to provide an improved ski without the disadvantages enumerated above.

Another object of this invention is to provide an improved shovel portion of all skis which produces a reduced vibration contribution and more control, can be constructed more simply and has a reduced tendency toward breakage.

SUMMARY

This invention has not been tried in the sports' filed of snow skiing. The prior section explained in the patents discussed that the connection between the toe and body of the snow ski is the weakest point of the ski. This plus, the vibrations from the inertia mass of the toe that is cantilevered off of the snow riding surface, will cause less control which will effect skier performance.

This invention has been tested and proven to functionally work in the aerospace industries.

First, what this invention will do is strengthen the weakest point of the ski. It is demonstrated in FIG. 2 by implementing the medical field terminology of putting a splint on a broken limb. Item 30 Support Brace Attachment will represent the splint which gets interlocked with item 10 J-tip Attachment through item 26 Snow Ski's interlock split. They will be secured together by item 40 Interlock flat head screws. The length of item 30 will determine the amount of stiffness of the front of the ski. Item 10 J-tip Attachment will stay in contact with the snow instead of riding over them.

Secondly, the new tip will reduce vibration of the snow ski by slicing through the snow instead of bouncing over the snow irregularities. This tip will allow the snow ski to stay in longer contact with the snow and provide more control for the skier which will improve their performance.

Third, these attachments can easily be installed on existing snow skis. It takes only a couple of holes to modify the ski. It will be up to the manufacturer to decide on if or when they would incorporate these attachments to the toe before it is fixed to the body of the ski.

Fourth, the manufacturer will determine the material and shape of all components of this invention. The shapes will easily vary for the different skill levels for ski's performance and type of ski.

Fifth, the possibility of increasing the variety of ski shapes, colors and esthetic presentations because the shovel element can be in different forms, colors and decorative contributions to the ski so that they can be utilized for identification of the ski type, ski size, individual ownership or any other purpose.

DRAWINGS—FIGURES

In the drawings, the boat haul/navicular design attachment will be referred to as the J-tip.

FIG. 1 Isometric view showing attachments of J-tip and top cover on existing snow ski.

Figure 2:
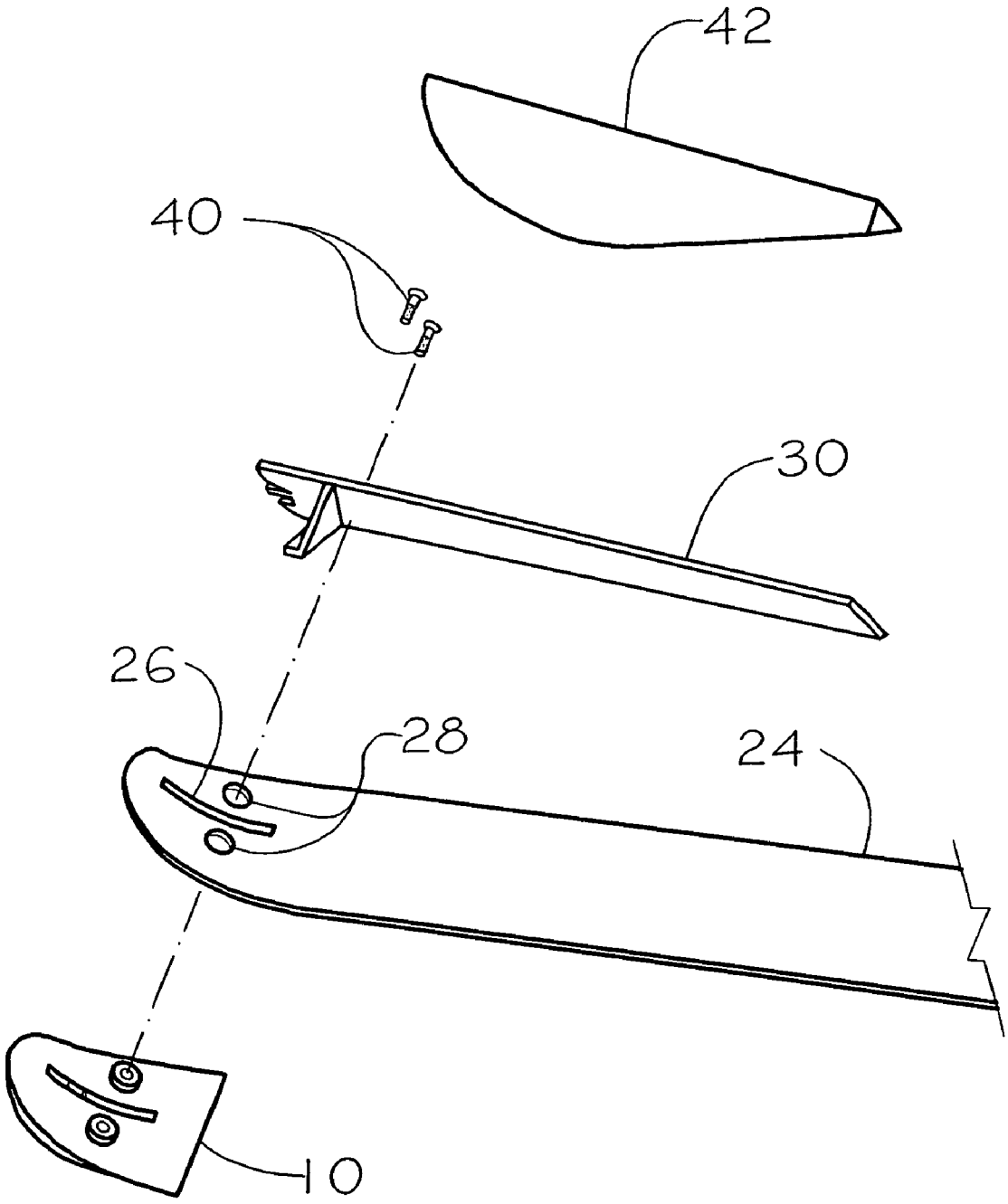

FIG. 2 Exploded view of all three attachments in relationship with existing snow ski.

Figure 3A:
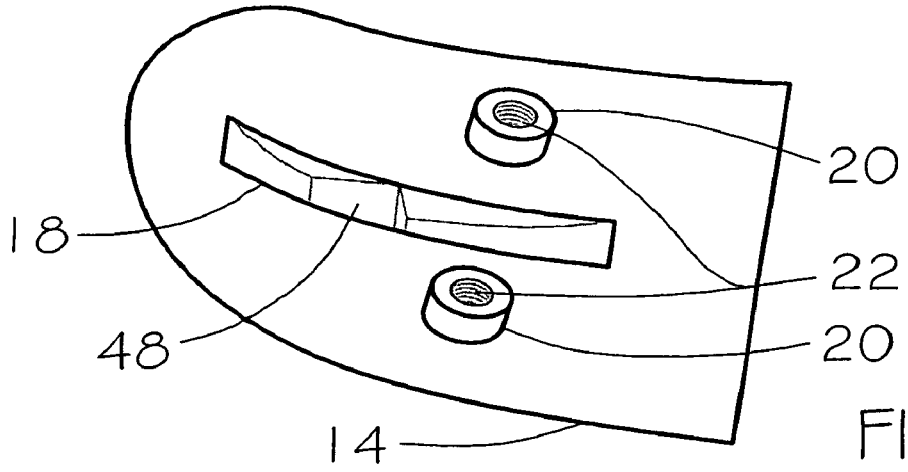

FIG. 3A Isometric view of the top of the J-tip attachment

Figure 3B:
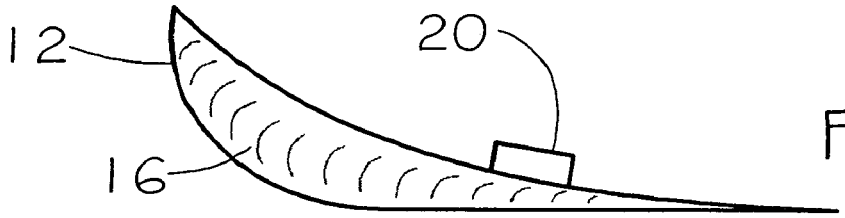

FIG. 3B Side view of J-tip attachment

Figure 4:
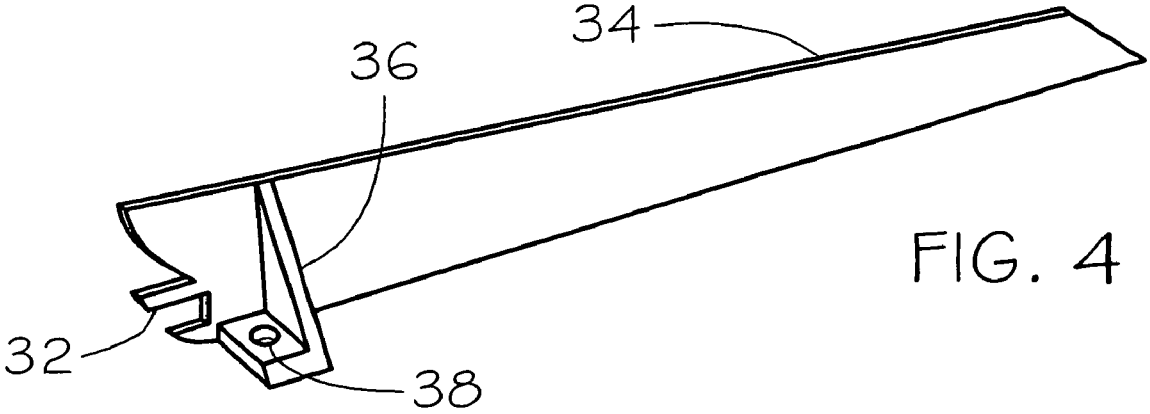

FIG. 4 Isometric view of the top support brace attachment

Figure 5:
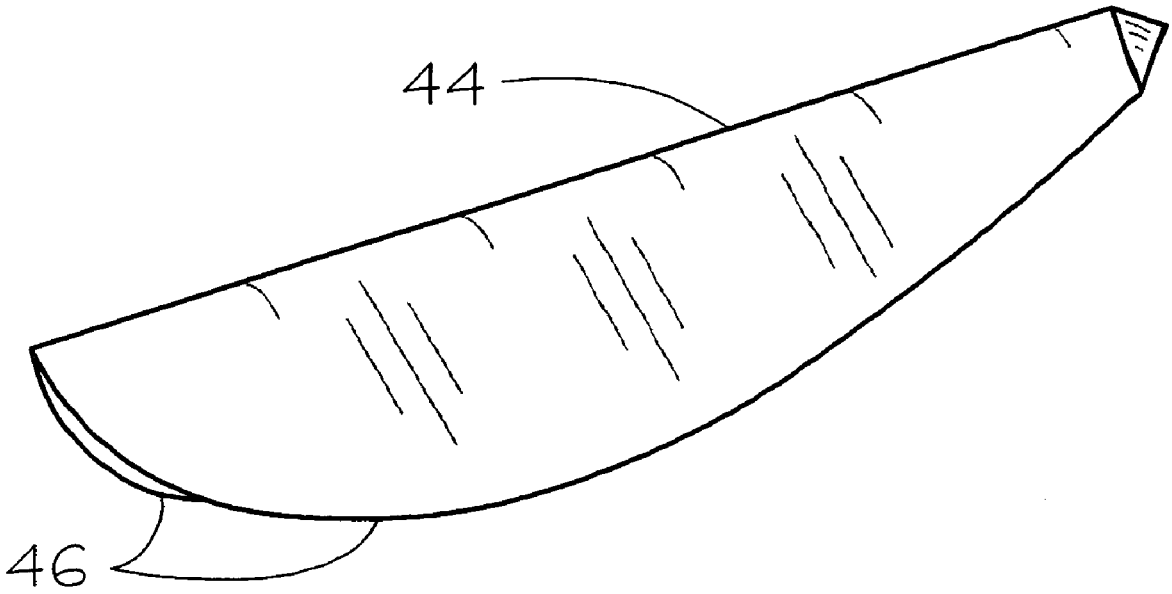

FIG. 5 Isometric view of the top cover attachment

DRAWINGS—REFERENCE NUMERALS

10 J-tip attachment
12 J-tip center line curve
14 J-tip edge curve
16 J-tip navicular curve
18 J-tip interlock slot
20 J-tip interlock posts
22 J-tip interlock post holes
24 Existing snow ski
26 Snow ski's interlock slit
28 Snow ski's access holes
30 Support brace attachment
32 Support brace interlock projection slit
34 Support brace center line
36 Support brace lateral arms
38 Support brace interlock hole
40 Interlock flat head screws
42 Top cover attachment
44 Top cover center line
46 Top cover edge
48 Horizontal notch

DETAILED DESCRIPTION—FIG. 2—PREFERRED EMBODIMENT

A preferred embodiment is shown in F*ig*.2 which is an exploded view of all three attachments in relationship with existing snow ski. The boat haul/navicular design, J-tip attachment 10 is secured to the bottom front tip of existing snow ski 24. The J-tip attachment can be seen better in FIG. 3A the isometric view of the top of the J-tip attachment and FIG. 3B side view of the J-tip attachment. The J-tip interlock posts 20 fit into the snow ski access holes 28 shown in FIG. 2.

The support brace attachment 30 shown in FIG. 2 is secured to the top front tip of the snow ski 24. The support brace attachment can be seen better in FIG. 4, the isometric view of the top support brace attachment. The support brace interlock projection slit 32 passes through the snow ski's interlock slit 26 and horizontally locks into the horizontal notch 48 located in the J-tip interlock slot 18 of FIG. 3A isometric view of the top of the J-tip attachment. The final securing of the J-tip attachment 10 to the support brace attachment 30 is performed by the interlock flat head screws 40 shown in FIG. 2 exploded view of all three attachments in relationship with existing snow ski. The interlock flat head screws 40 pass through the support brace interlock holes 38 shown in FIG. 4 isometric view of the top support brace attachment, and screw into the J-tip interlock post holes 22 seen in FIG. 3A isometric view of the top of the J-tip attachment. This procedure is the referred to statement of "Placing a splint on a broken limb" which strengthens the point defined as the weakest part of the snow ski.

The third attachment is the top cover attachment 42 shown at the top of FIG. 2 exploded view of all three attachments in relationship with existing snow ski, is fixed to the support brace center line 34, support brace lateral arms 36 and the top surface of the snow ski 24 shown in FIG. 2 exploded view of all three attachments in relationship with existing snow ski. This adds to the strength of the previously mentioned splint.

The manufacturer will determine the material and shape of this invention. The two critical curves of this invention are located at the bottom of the J-tip attachment 10 and are shown as J-tip centerline curve 12 and J-tip navicular curve of FIG. 3B side view of the J-tip attachment and also shown in FIG. 1 isometric view showing attachments of J-tip and top cover on existing snow ski.

The J-tip edge curve 14, that is shown in isometric view of the top of the J-tip attachment FIG. 3A will be designed to conform to the shape of the existing snow ski. This also applies to top cover edge 46 shown in FIG. 5 isometric view of the top cover attachment. The top cover centerline 44 shown in FIG. 5, isometric view of the top cover attachment, will be secured to the support brace centerline 34 in FIG. 4 isometric view of the top support brace attachment.

Operation—FIGS. 1, 2, 3B

This invention draws it's origin from the aerospace industry. Proven concept of a boat haul/navicular design snow ski setup for aircraft.

What the major influence of this invention's operating function is to cut/slice through the irregularities of the snow surface instead of bouncing over them. This will allow the snow ski's edge to stay in contact with the snow and increase the amount of control improving skier's performance.

In FIG. 1 isometric view showing attachments of J-tip and top cover on existing snow ski can be seen the two critical curves of this invention. These curves are to be determined by the ski manufacturer's design. The name of one curve is the J-tip navicular curve 16. The other is the J-tip centerline curve 12 seen in FIG. 3B side view of J-tip attachment. These two curves function as the separating of the snow from centerline of snow ski to the edges of the snow ski.

In FIG. 2 exploded view of all three attachments in relationship with existing snow ski. A total of three openings are needed. Two are the snow ski's access holes 28 and one is the snow ski's interlock slit 26. These openings allow physical contact between the J-tip attachment 10 and the support brace attachment 30. Therefore sharing the impact load of irregularities of the snow surface evenly along the front of the snow ski's bearing surface.

Besides the use of glues and adhesives or laminates, the J-tip attachment 10 will establish a strong bond with the support brace attachment 30 through the utilization of the interlock flat head screws 40.

The function of length of the support brace attachment 30 is to stiffen the front tip of the snow ski and keep the J-tip attachment 10 in constant contact with the snow surface. The manufacturer will determine this length for their type and style of snow ski. The J-tip attachment 10 can only operate correctly if it is in continuous contact with the snow surface. The more contact with the snow surface will decrease the vertical vibration and give the skier more control of their ski.

The third attachment is the top cover attachment 42 and shown in FIG. 2 exploded view of all three attachments in relationship with existing snow ski. The top cover attachment 42 provides four functions. The cover has an apex which extends in the longitudinal direction of the snow ski, and the cover has two sides which slope downward from the apex. The sides extend to the top surface of the snow ski tip, respective lower edges of each of said sides mates to the contour of the top surface of the snow ski tip. The lower edges of each said side tapper from covering the entire width of the tip of the snow ski to covering only a portion of the width of the snow ski as the cover gets closer to the center of the snow ski.

The first is to provide additional strength to the support brace attachment 30.

The second is to establish aerodynamic flow over the top of the snow ski. The manufacturer will determine the shape of this attachment The third is the value of esthetic presentation for a raised surface that provides a decorative contribution to the ski so that they can be utilized for identification to the ski type, ski style, individual ownership or any other purpose.

The fourth function is that it provides anti-ski crossover and forces the erroring snow ski to return back in the correct direction.

Another embodiment, not shown, would be the future manufacturer's decision in incorporating the preferred embodiment just discussed with the pre-manufactured section of the snow ski tip. The background information explains that the toe, shovel, tip section is added to the snow ski body during assembling. This invention could already be added to this pre-manufactured section and be assembled as normal routine.

The above alternated embodiment, will operate exactly as defined in the above operation of the preferred embodiment.

Conclusion, Ramifications and Scope of Invention

Thus the reader will see that these attachments will provide an improved shovel portion of the snow ski dealing with control by cutting through the snow and not bouncing over it, this decrease of bouncing will then reduce the amount of vibration and improving the level of skier's performance.

The elevated portion of the top cover will provide an esthetic presentation that provides a decorative contribution to the snow ski.

The application of these attachments will work in combination to strength the weakest defined portion of the snow ski, the toe to body connection, The one ramification of this invention would be the other defined embodiment, not shown, involving the attachments being already incorporated in the pre-manufactured toe component. This will be a manufacturer's decision.

I claim:

1. A combination of a snow ski tip attachment and a snow ski comprising:

a) a boat haul/navicular J-tip which is positioned on a bottom surface of a snow ski tip; said J-tip has an interlock slot and two threaded holes;

b) a support brace positioned on a top surface of said snow ski tip; said support brace has an interlock projection slit and two interlock holes;

c) a top cover built to fully encapsulate said support brace between said cover and said top surface of said snow ski tip; wherein the cover has an apex which extends in the longitudinal direction of said snow ski; furthermore the cover has two sides which slope downward from said apex; said sides extend to said top surface of said snow ski tip, respective lower edges of each of said sides mates to the contour of the top surface of said snow ski tip; said lower edges of each said side tapper from covering the entire width of said tip of said snow ski to covering only a portion of the width of said snow ski as the cover gets closer to the center of said snow ski;

d) said J-tip is joined to said support brace through access holes and an interlock slot within said snow ski; said threaded holes, said interlock holes, and said access holes align with one another in such a manner so as to allow for two threaded fasteners to be inserted through the interlock holes, then through the access holes, and then threaded into the threaded holes; and said interlock slit allows for said interlock projection slit to be inserted into said interlock slot.

* * * * *